United States Patent [19]

Hogue et al.

[11] 4,209,487

[45] Jun. 24, 1980

[54] METHOD FOR CORROSION INHIBITION

[75] Inventors: Ronald D. Hogue, Manchester; Thomas M. King, Creve Coeur; Robert S. Mitchell, Webster Groves, all of Mo.

[73] Assignee: Monsanto Company, St. Louis, Mo.

[21] Appl. No.: 677,467

[22] Filed: Apr. 15, 1976

Related U.S. Application Data

[63] Continuation-in-part of Ser. No. 583,135, Jun. 2, 1975, abandoned.

[51] Int. Cl.[2] ..... C23F 11/10

[52] U.S. Cl. ..... 422/12; 422/53; 422/15; 422/16; 252/389 A

[58] Field of Search ..... 21/2.7 A, 2.5 A; 252/389 A, 181

[56] References Cited

U.S. PATENT DOCUMENTS

| | | | |
|---|---|---|---|
| B 336,566 | 1/1975 | Powell | 21/2.5 A X |
| 3,738,806 | 6/1973 | Feiler | 21/2.7 A |
| 3,803,048 | 4/1974 | Hwa | 21/2.5 A X |
| 3,816,333 | 6/1974 | King et al. | 21/2.5 A X |
| 3,837,803 | 9/1974 | Carter et al. | 21/2.7 A |
| 3,890,228 | 6/1975 | Hwa et al. | 21/2.7 A X |

*Primary Examiner*—Norman Yudkoff
*Attorney, Agent, or Firm*—George R. Beck

[57] ABSTRACT

1,2-Ethane diphosphonates of the general formula $$M_2O_3P—CH_2CH_2—PO_3M_2$$

wherein M is hydrogen, metal ion, ammonium, alkyl ammonium or mixtures thereof, are disclosed as inhibiting the corrosion of metals by oxygen-bearing waters. The 1,2-ethane diphosphonates can be employed either alone or in combination with certain thiols, 1,2,3-triazoles, zinc salts, chromates, silicates, inorganic phosphates, molybdates, tannins, lignins, lignin sulfonates, certain calcium and magnesium salts and mixtures thereof.

10 Claims, No Drawings

METHOD FOR CORROSION INHIBITION

BACKGROUND OF THE INVENTION

The present application is a continuation-in-part of application Ser. No. 583,135 filed June 2, 1975, now abandoned.

The present invention relates to corrosion inhibitors and to methods of inhibiting corrosion of metal surfaces in contact with an aqueous medium of corrosive nature. More particularly, this invention relates to methods of inhibiting the corrosion of metal surfaces by utilizing in the corrosive aqueous medium certain 1,2-ethane diphosphonate compounds which do not require the addition of heavy metal ions to effectively inhibit corrosion.

The present invention has special utility in the prevention of the corrosion of metals which are in contact with circulating water, that is, water which is moving through condensers, engine jackets, cooling towers, evaporators or distribution systems; however, it can be used to prevent the corrosion of metal surfaces in other aqueous corrosive media. This invention is especially valuable in inhibiting the corrosion of ferrous metals including iron and steel, and also galvanized steel, and nonferrous metals including copper and its alloys, aluminum and its alloys and brass. These metals are generally used in circulating water systems.

The major corrosive ingredients of aqueous cooling systems are primarily dissolved oxygen and inorganic salts, such as the carbonate, bicarbonate, chloride and/or sulfate salts of calcium, magnesium and/or sodium. Other factors contributing to corrosion are pH and temperature. Generally an increase in the temperature and a decrease in the pH accelerates corrosion.

It is well-known that certain corrosion inhibiting compositions of organic phosphonates are enhanced in their effectiveness by the addition of zinc salts and/or chromates to the inhibiting compositions. However, the use of zinc salts and chromates has been found in recent years to adversely affect water quality when released in natural waters. Removal of the zinc and/or chromate ions by precipitation or other treatments is complicated and expensive. Consequently, effective corrosion inhibiting compositions free of such heavy metal ions are now desired by industry for protection of metallic equipment without the accompanying disadvantages of the heavy metal ions previously employed.

SUMMARY OF THE INVENTION

It is a primary object of this invention to provide new corrosion inhibiting methods for metals.

It is another object of this invention to provide new corrosion inhibiting methods for ferrous metals including iron and steel and nonferrous metals including copper and brass.

It is another object of this invention to provide new corrosion inhibiting methods for ferrous metals and nonferrous metals in contact with an aqueous corrosive medium.

It is another object of this invention to provide new corrosion inhibiting methods for ferrous metals and nonferrous metals in contact with cooling waters.

Other advantages and objects of the present invention will be apparent from the following discussion and appended claims.

It has been found that certain 1,2-ethane diphosphonates unexpectedly function as excellent corrosion inhibitors and do not require the presence of heavy metal ions to be effective, although they can be used in conjunction with all well-known water treating composition ingredients without being adversely affected in their corrosion inhibiting properties. The nature of these 1,2-ethane diphosphonates and methods of use thereof as corrosion inhibitors are more fully set forth in the description of preferred embodiments below.

DESCRIPTION OF PREFERRED EMBODIMENTS

The 1,2-ethane diphosphonates useful in the present invention correspond to the following formula:

$$M_2O_3P—CH_2CH_2—PO_3M_2 \quad (I)$$

wherein M is hydrogen, metal ion, ammonium, alkylammonium or mixtures thereof.

In the above formula M can be alike or unlike and is selected from the group of metal ions and hydrogen or any cation which will yield sufficient solubility in the aqueous corrosive media to function as a corrosion inhibitor. The aforementioned metal ions are from the group of metals which includes, without limitation, alkali metals such as sodium, lithium and potassium; alkaline earth metals such as calcium and magnesium; aluminum, zinc, cadmium, manganese, nickel, cobalt, cerium, lead, tin, iron, chromium, copper, gold and mercury. Also included are ammonium ions and alkylammonium ions. In particular, those alkylammonium ions derived from amines having a low molecular weight, such as below about 300, and more particularly the alkyl amines, alkylene amines, and alkanol amines containing not more than two amine groups, such as ethylamine, diethylamine, propylamine, propylene diamine, hexylamine, 2-ethylhexylamine, N-butyl ethanol amine, triethanol amine and the like are the preferred amines. It is to be understood that the preferred metal ions are those which render the compound a water-soluble salt in concentrations of at least 10 and preferably at least 100 parts per million in aqueous solution, such as the alkali metals, as well as the water-soluble salts from ammonium, alkylammonium and alkanol amine ions.

The compounds useful in the present invention are prepared by well-known methods including the classical Arbuzov reaction, among other, and, as such, form no part of the present invention. In general, the ester forms of the ethane diphosphonates are prepared by reacting a trialkyl or alkali metal dialkyl phosphite with a dihaloethane. Alternatively, an alkali metal dialkyl phosphite can be reacted with a monohaloethylene phosphite. The acid form of the ethane diphosphonate alkyl esters are produced when such esters are hydrolyzed to the phosphonic acid form. The ammonium and metal salts described above are produced from the ethane diphosphonic acid products by a partial or full neutralization with the corresponding hydroxide, carbonate, amine or the like. Thus the acid and salt forms of the 1,2-ethane diphosphonates embraced by Formula (I) are readily produced.

The 1,2-ethane diphosphonate corrosion inhibitors of the present invention effectively inhibit corrosion when utilized at at least three parts per million, preferably from 10 ppm to about 500 ppm, and more preferably from about 10 ppm to 150 ppm in the corrosive medium. It is to be understood that greater than 500 ppm of these 1,2-ethane diphosphonates can be utilized if desired so long as the higher amounts are not detrimental to the water system. Amounts as low as 1 ppm are effective under some conditions.

The 1,2-ethane diphosphonate corrosion inhibitors of the present invention are effective in both acidic or basic aqueous corrosive media. The pH can range from about 4 to about 12. For example, 1,2-ethane diphosphonic acid when used in amounts of from about 3 ppm to 150 ppm is an effective corrosion inhibitor in an aqueous corrosive medium where the pH is from about 4 to about 12. In cooling towers, the water system is generally maintained at a pH of from about 6.5 to 10.0, and most often at a pH of from about 6.5 to 8.5. In all such systems the inhibitors of the present invention are effective.

The 1,2-ethane diphosphonates of the present invention have been found to be surprisingly and unexpectedly superior in the inhibition of corrosion of metals in contact with a corrosive aqueous medium to the related alkane, alkylidene and alkene diphosphonates which would be expected to be highly effective in inhibiting such corrosion. The 1,2-ethane diphosphonic acid and water-soluble salts have demonstrated corrosion rates of metals ranging from 6 to 50 times less than the rates shown by these related aliphatic diphosphonates at identical concentrations in the same corrosion aqueous medium. Such results should not have been predicted from prior known applications of such aliphatic diphosphonates.

Particularly when the water systems are in contact with various metals, such as steel and copper or copper-containing metals, it is frequently desirable to use, along with the 1,2-ethane diphosphonate corrosion inhibitors, a 1,2,3-triazole, such as 1,2,3-benzotriazole or 1,2,3-tolyltriazole, or a thiol of a thiazole, an oxazole or an imidazole such as are known in the art to inhibit corrosion. These azoles are likewise effective with the 1,2-ethane diphosphonates of the present invention. The amount of the azoles used depend on the particular aqueous system. Generally concentrations of about 0.05 to 5 ppm thiol or triazole with about 3 to 150 ppm of 1,2-ethane diphosphonate are satisfactory; preferably the concentrations will range from 0.5 to 2 ppm of the thiol or triazole and about 10 to 50 ppm of the 1,2-ethane diphosphonates of this invention.

It is within the scope of the present invention that the 1,2-ethane diphosphonate corrosion inhibitors may also be used in aqueous systems which contain various inorganic and/or organic materials, particularly all ingredients or substances used by the water-treating industry, with the proviso that such materials do not render the 1,2-ethane diphosphonates substantially ineffective for the desired purpose of corrosion inhibition. In some instances, there can be a cooperative effect between the 1,2-ethane diphosphonates of this invention and the other added materials. For example, the 1,2-ethane diphosphonates of the present invention can be employed with both water soluble zinc salts and/or chromates in the inhibition of corrosion in an aqueous corrosive medium.

Others of these organic and inorganic materials which can be used effectively with the 1,2-ethane diphosphonates of the present invention include, without limitation, polycarboxylates, particularly those whose molecular weights are from about 2,000 to about 20,000 and from about 20,000 to 960,000; anti-foam agents; water soluble polymers such as polyacrylic acid, polyacrylamide, partially hydrolyzed acrylamide and the like; tannins; lignins; deaerating materials; polymeric anhydrides (such as polymaleic anhydride); and sulfonated lignins. Other materials which can be used with said inhibitors include, for example, surface active agents, acetodiphosphonic acids, inorganic phosphates including orthophosphates, molecularly dehydrated phosphates and phosphonates, polyfunctional phosphated polyol esters, calcium and magnesium salts such as calcium or magnesium chlorides, sulfates, nitrates and bicarbonates and inorganic silicates. Furthermore, scale and precipitation inhibitors such as amino tri(methylene phosphonic acid) may be used in combination with the inhibitors of the present invention. For exemplary purposes only, these other precipitation inhibitors are described in U.S. Pat. No. 3,234,124; U.S. Pat. No. 3,336,221; U.S. Pat. No. 3,393,150; U.S. Pat. No. 3,400,078; U.S. Pat. No. 3,400,148; U.S. Pat. No. 3,434,969; U.S. Pat. No. 3,451,939; U.S. Pat. No. 3,462,365; U.S. Pat. No. 3,480,083; U.S. Pat. No. 3,591,513; U.S. Pat. No. 3,597,352 and U.S. Pat. No. 3,644,205, all of which publications are incorporated herein by reference. Other corrosion inhibitors can be used in combination with 1,2-ethane diphosphonates including those described in U.S. Pat. No. 3,483,133; U.S. Pat. No. 3,487,018; U.S. Pat. No. 3,518,203; U.S. Pat. No. 3,532,639; U.S. Pat. No. 3,580,855; and U.S. Pat. No. 3,592,764, all of which are incorporated herein by reference.

The following examples are included to illustrate the practice of the present invention and the advantages provided thereby but are not to be considered limiting. Unless otherwise specified, all parts are parts by weight and all temperatures are in degrees Centigrade.

EXAMPLE A

Tetraethyl ethane-1,2-diphosphonate is prepared by the following reaction. There is charged to a reaction flask 125 grams of metallic sodium in xylene emulsion, 1,000 ml. of diethyl ether and 460 ml. of diethyl phosphite and the mixture heated at reflux for 2 to 4 hours. Then there is added to the reaction flask 830 g. of diethyl bromoethylene phosphite and the mixture refluxed for 6 to 8 hours. The ether is evaporated, the reaction mixture is extracted several times with diethyl ether and the combined extracts are vacuum distilled under 1 mm. pressure yielding a fraction at 160° C., comprising 85 g. of the desired tetraethyl ester. 70 g. of the tetraethyl ester is hydrolyzed by refluxing with 100 ml. of concentrated HCl for 48 hours. The product mixture is evaporated to a dry solid and recrystallized from water to produce the 1,2-ethane diphosphonic acid. Titration of a sample of the 1,2-ethane diphosphonic acid with 1/10 normal NaOH solution demonstrates two breaks in the curve, i.e., at pH of 5 and 10, indicating the disodium and tetrasodium salts respectively of 1,2-ethane diphosphonic acid.

EXAMPLE B

In a variation of the preparation procedure the tetraethyl ester of ethane-1,2-diphosphonic acid, the acid and the disodium and tetrasodium salts thereof are prepared by reacting 1,2-dibromoethane with 2 moles of sodium diethyl phosphite at reflux for 12 to 16 hours and vacuum distilling to yield the tetraethyl ethane-1,2-diphosphonate. The ester is hydrolyzed with HCl and added HBr to produce the 1,2-ethane-diphosphonic acid which is neutralized with dilute NaOH to produce the disodium salt at pH 5 and the tetrasodium salt at pH 10.

The surprising effectiveness of the 1,2-ethane diphosphonates of this invention as inhibitors of the corrosion of metals by oxygenated waters is shown by tests determining metallic corrosion rates. The tests were conducted in polarization test cells employing steel electrodes with synthetic, very hard municipal water at an initial pH of 7.0 and continuous aeration. The concentrations of the compounds tested are calculated on the basis of active acid form of the respective aliphatic diphosphonate and the tests carried out at two concentrations of 50 and 150 ppm in the synthetic hard water test medium. The rates of corrosion are determined by the Tafel Slope Extrapolation Method as described in "Handbook of Corrosion, Testing and Evaluation" by Dean, France and Ketchum published by Wiley-Interscience, New York (1971), Chapter 8, from the observed current densities and are expressed in terms of mils per year of metal loss. The corrosion rates of the steel electrodes, when protected by the test concentrations of the compounds tested, can then be compared to the corrosion rate of those electrodes when unprotected by a corrosion inhibitor. The decrease in the corrosion rate expressed in mils per year indicates the effectiveness of a compound as a corrosion inhibitor.

The synthetic hard municipal water used in the test described is prepared to approximate very hard municipal water as follows:

| INGREDIENTS | MG/L |
|---|---|
| Calcium | 88 |
| Magnesium | 24 |
| Chloride | 70 |
| Sulfate | 328 |
| Bicarbonate | 40 |
| Total hardness as $CaCO_3$ in distilled water | 319 |

Tests determining the metallic corrosion rates in oxygenated water established by the 1,2-ethane diphosphonates of this invention and other aliphatic diphosphonates are set out in the following examples:

EXAMPLE I

The corrosion rates of a steel electrode at 35° C. in the synthetic hard municipal water medium described above, without added inhibitor and containing the indicated concentrations of 1,2-ethane diphosphonic acid and the test solutions adjusted to an initial pH of 7.0, are determined as discussed above by the Tafel Slope Extrapolation Method. The results are set out in Table I below:

TABLE I

| Test Compound | Concentration of Corrosion Inhibitor (ppm) | Corrosion Rate (m.p.y.) |
|---|---|---|
| Control | None | 42 |
| 1,2-Ethane Diphosphonic Acid | 50 | 2 |
| | 150 | 0.2 |

EXAMPLE II

The corrosion rates are determined in the same manner and in the same medium as in Example I above of the other aliphatic diphosphonates indicated at the identical concentrations of the active acid form of each compound tested, the test solutions being adjusted to an initial pH of 7.0. The corrosion rates at a concentration of 50 ppm in comparison to such rates with 1,2-ethane diphosphonic acid are set out in Table II while such rates are compared at a concentration of 150 ppm in Table III below.

TABLE II (at 50 ppm. concentration)

| Compound | Name | Corrosion Rate (m.p.y.) |
|---|---|---|
| A | 1,2-Ethane diphosphonic acid | 2.0 |
| B | Methylene diphosphonic acid | 4.6 |
| C | 1,3-Propane diphosphonic acid | 19 |
| D | 2,2-Propane diphosphonic acid | 16 |
| E | 1,4-Butane diphosphonic acid | 2.7 |
| F | 1,10-Decane diphosphonic acid | 32 |
| G | Ethylidene-1,1-diphosphonic acid | 20 |
| H | Ethene-1,1-diphosphonic acid | 6.2 |
| I | 1-Hydroxy ethylidene-1,1-diphosphonic acid | 6.0 |

TABLE III (at 150 ppm. concentration)

| Compound | Name | Corrosion Rate (m.p.y.) |
|---|---|---|
| A | 1,2-Ethane diphosphonic acid | 0.2 |
| B | Methylene diphosphonic acid | Ppt'd.* |
| C | 1,3-Propane diphosphonic acid | 1.8 |
| D | 2,2-Propane diphosphonic acid | 10 |
| E | 1,4-Butane diphosphonic acid | 1.3 |
| F | 1,10-Decane diphosphonic acid | 1.2 |
| G | Ethylidene-1,1-diphosphonic acid | 4.6 |
| H | Ethene-1,1-diphosphonic acid | 7.6 |
| I | 1-Hydroxy ethylidene-1,1-diphosphonic acid | 10 |

*Ppt'd. - Metallic salt of test compound precipitated from solution.

It is evident from the above data that Compound A, 1,2-ethane diphosphonic acid, is unexpectedly superior to all the other aliphatic diphosphonates tested under all test conditions. It is also evident from Table III that at increased concentrations the unexpected superiority of Compound A is even greater. Thus, in Table II at a concentration of 50 ppm, the Compounds B through I ranged from 135% to 1600% of the corrosion rate demonstrated by the 1,2 -ethane diphosphonate, Compound A, while in Table III at a concentration of 150 ppm, the corrosion rates of Compounds B through I ranged from 600% to 5000% of the corrosion rate of Compound A. This surprisingly great difference in effectiveness as a corrosion inhibitor in corrosive aqueous media of the 1,2-ethane diphosphonate was totally unexpected.

The foregoing examples have been described in the specification for the purpose of illustration and not limitation. The corrosion inhibiting compounds of this invention can be employed in a number of forms which will give good protection against corrosion. For example, the 1,2-ethane diphosphonates, either in the form of acid or salts, alone or in combination with other corrosion and scale inhibiting materials, as outlined above, including thiols, 1,2,3-triazoles, water soluble zinc salts, chromates, silicates, inorganic phosphates, molybdates, tannins, lignins, lignin sulfonates, and calcium and/or magnesium salts, can simply be dissolved by mixing them into the aqueous corrosive medium. In another method they can be dissolved separately in water or another suitable solvent and then intermixed with the aqueous corrosive medium.

Various means are available to insure that the correct proportion of corrosion inhibitor is present in the corrosive medium. For example, a solution containing the said corrosion inhibitor can be metered into the corrosive medium by drop feeder. Another method is to formulate tablets or briquettes of a solid 1,2-ethane diphosphonate, with or without other ingredients, and these can be added to the corrosive medium. The said solid, after briquetting, can be used in a standard ball feeder so that the solid is released slowly in the corrosive medium.

What is claimed is:

1. A method of inhibiting the corrosion of metals in contact with an aqueous corrosive medium which comprises maintaining in said medium at least about 3 parts per million of 1,2-ethane diphosphonic acid or a water soluble salt thereof having the formula $$M_2O_3P—CH_2CH_2—PO_3M_2$$

wherein each M is individually selected from the group consisting of hydrogen, alkali metal ions, ammonium ions and alkyl ammonium ions.

2. The method of claim 1 wherein the amount of said 1,2-ethane diphosphonate maintained in said medium is from about 3 to about 500 parts per million.

3. The method of claim 1 wherein the said inhibited metals are selected from the group consisting of ferrous metals, copper, aluminum and brass.

4. The method of claim 1 comprising 1,2-ethane diphosphonic acid.

5. The method of claim 1 wherein at least one M is an alkali metal ion.

6. The method of claim 5 wherein at least two M are hydrogen.

7. The method of claim 1 wherein at least one M is an ammonium ion.

8. The method of claim 1 wherein the aqueous medium additionally contains a compound selected from the group consisting of 1,2,3-triazoles, thiols of thiazoles, thiols of oxazoles, thiols of imidazoles and mixtures thereof in an amount of at least 0.05 parts per million.

9. The method of inhibiting the corrosion of metals in contact with an aqueous corrosive medium which comprises maintaining in said medium at least 10 parts per million of 1,2-ethane diphosphonic acid.

10. The method of claim 9 wherein the said diphosphonic acid is in the form of the disodium salt.

* * * * *